United States Patent [19]

Schwitters

[11] B 3,995,770

[45] Dec. 7, 1976

[54] APPARATUS FOR DISPENSING BEVERAGES

[75] Inventor: Steve W. Schwitters, Rockford, Ill.

[73] Assignee: Beatrice Foods Co., Chicago, Ill.

[22] Filed: Mar. 19, 1975

[21] Appl. No.: 559,697

[44] Published under the second Trial Voluntary Protest Program on March 16, 1976 as document No. B 559,697.

[52] U.S. Cl. ..... 222/56; 222/67; 222/129.1; 222/146 C; 222/148; 222/145

[51] Int. Cl.[2] ..... B67D 5/56; B67D 1/08

[58] Field of Search ..... 222/64–69, 222/56, 129.1, 146 C, 144.5, 145, 318, 148

[56] References Cited

UNITED STATES PATENTS

| | | | |
|---|---|---|---|
| 3,120,326 | 2/1964 | Hedeman | 222/148 X |
| 3,224,740 | 12/1965 | Kuehn | 222/145 X |
| 3,276,633 | 10/1966 | Rahauser | 222/129.1 |
| 3,398,550 | 8/1968 | Lents | 222/64 X |
| 3,460,716 | 8/1969 | Thomas | 222/129.1 |
| 3,830,407 | 8/1974 | Wierlo | 222/145 |

*Primary Examiner*—Allen N. Knowles
*Attorney, Agent, or Firm*—Morsbach & Pillote

[57] ABSTRACT

An apparatus for dispensing semi-frozen beverages containing water, a flavoring syrup and carbon dioxide in which the water and flavoring syrup are delivered under a pre-set substantially constant pressure through respective water and syrup flow restrictors to a mixed beverage delivery line so that the proportions of the water and syrup in the mixed beverage are controlled by the water and beverage flow restrictors. The apparatus includes mechanism for selectively passing water under the gas pressure in a reverse direction through the syrup flow restrictor to back flush and clean the same. The apparatus also includes mechanism for automatically controlling the flow of mixed beverage to the freezing chamber and the venting of gas from the freezing chamber to maintain the liquid in the chamber at a preselected level and pressure.

20 Claims, 7 Drawing Figures

APPARATUS FOR DISPENSING BEVERAGES

BACKGROUND OF THE INVENTION

Beverage dispensing apparatus have heretofore been made in which a flavoring syrup is separately stored and then mixed with water to produce a beverage. It has heretofore been proposed to make a beverage dispensing device utilizing separate water and syrup metering orifices for respectively metering the flow of water and syrup to a dispenser. However, the flavoring syrup concentrate frequently contains or forms gelatinous and or crystaline particles which tend to clog the syrup metering orifice and markedly change the proportions of syrup and water in the mixed beverage. In the prior dispensing apparatus of this type, it was necessary to disassemble the syrup metering orifice and syrup filter in order to clean the same. The disassembly, cleaning and reassembling of the syrup orifices and filters was tedious and time consuming and such prior apparatus were objectionable either as requiring too much operator time in order to maintain proper operation or as being inaccurate in metering if the operator failed to clean the same as often as necessary. In order to overcome the above difficulties encountered in orifice type metering devices, it has also been proposed to use a positive displacement type pump for positively pumping the water and the syrup to the dispenser. While such devices are less susceptible to problems due to gelatinous or crystaline particles in the syrup, they are more complex and hence more expensive to build and difficult to service.

It has also been known to produce semi-frozen or slush type carbonated beverages by passing a carbonated beverage mix to a freezing chamber that refrigerates and agitates the carbonated beverage to form a semi-frozen product. Some prior apparatus operate the freezing chamber at atmospheric pressure. However, the carbon dioxide tends to escape from the beverage at atmospheric pressure, particularly when allowed to stand for a substantial period of time, and the yield or overrun in such apparatus is not as high or as uniform as is desirable. In order to achieve a higher and more uniform yield or overrun, it has also been proposed to operate the freezing chamber at above atmospheric pressure. However, in such pressurized freezing chambers difficulties are encountered in accurately controlling the pressure and liquid level in the freezing chambers.

SUMMARY OF THE INVENTION

The present invention generally relates to an apparatus for dispensing beverages containing water, a flavoring syrup and food-grade gas. It is an object of this invention to provide an apparatus for dispensing beverages having an improved system for proportioning the water and flavoring syrup and which is simple to operate and which will consistently produce a beverage of preselected composition.

Another object of this invention is to provide an apparatus for dispensing beverages in which proportioning of the water and flavoring syrup is effected by water and flavoring syrup flow restrictors and in which the syrup flow restrictor can be cleaned in place and in a very short time and without adverse affect on the beverage ingredients or beverage mixture in the remainder of the dispenser.

A more particular object of this invention is to provide an apparatus for dispensing beverages in accordance with the foregoing object in which the cleaning of the syrup orifice is effected by back flushing of the syrup orifice while in place in the system and utilizing water under the gas pressure of the system.

Yet another object of this invention is to provide a beverage dispensing apparatus in which the relative proportions of syrup and water can be readily adjusted and the adjusted mixture then sampled without draining all or a substantial part of the beverage dispensing system.

The present invention also relates to an apparatus for dispensing semi-frozen beverages containing a water or flavoring syrup and a food-grade gas.

It is another object of this invention to provide an apparatus for dispensing semi-frozen beverages having an improved arrangement for delivering the beverage to a freezing chamber to produce a semi-frozen product therein.

Another object of this invention is to provide an apparatus for dispensing semi-frozen beverages in accordance with the foregoing object having an improved arrangement for maintaining the liquid in the freezing chamber at a preselected level and in a preselected pressure range to provide a frozen beverage having more uniform composition; to minimize spurting during dispensing; and to prevent build-up of excessive pressure in the freezing chamber due to expansion of the product during freezing.

These, together with other objects and advantages of this invention will be more readily understood by reference to the following detailed description when taken in connection with the accompanying drawings wherein.

Figure 6:
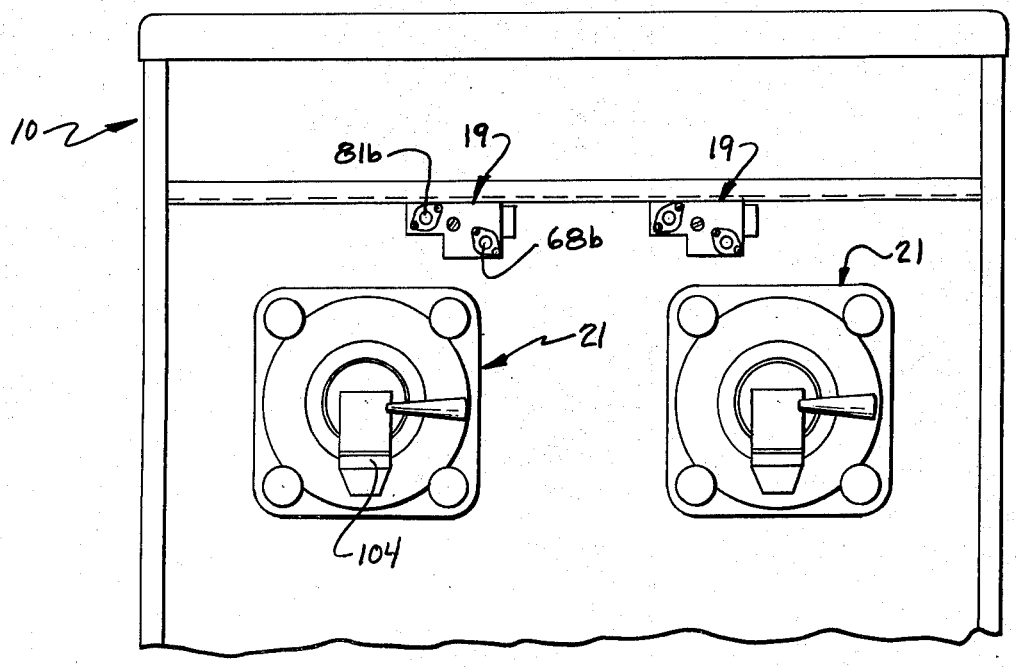
FIG. 6 is a fragmentary front elevational view of a machine for dispensing a semi-frozen beverage.

The principles of the present invention are particularly useful when embodied in a beverage dispensing apparatus such as shown in the drawings and designated generally by the numeral 10. The system in general includes a water storage vessel 15, a syrup storage vessel 16, and a tank 17 containing a food-grade gas such as carbon dioxide. The water and flavoring syrup are delivered under gas pressure to a proportioning apparatus 19 to a freezing and dispensing cylinder 21. The beverage dispensing machines are frequently arranged to dispense two or more beverages as shown in FIG. 6. However, the beverage dispensing system is substantially duplicated for each different beverage to be dispensed. Accordingly, only a single beverage dispensing system is described herein.

The water supply vessel is preferably maintained filled to a preselected level and, for this purpose, a water supply source such as a conventional municipal supply S is connected through a pressure regulator 23, a valve 24 and line 25, to a water inlet 26 that extends into the vessel 15. The water pressure regulator 15 is set to deliver water to the water storage vessel under a pre-set pressure described more fully hereinafter and the valve 24 is operated by a level control 31 in the vessel 15 between an open and closed position to maintain the liquid level Lw in the vessel 15 within a preselected range.

The water in the storage vessel 15 is preferably cooled to a preselected temperature by the evaporator coil 32 of the refrigeration system that includes a compressor 33, condenser 34 and refrigerant expansion valve 35, and the refrigeration system is cycled on and off by a temperature control 126 to maintain the temperature in the storage vessel somewhat above the freezing temperature of water, for example about 34° F. The water entering the water storage vessel is preferably pre-cooled by a pre-cooled coil 37 in the water inlet line 25 and disposed around the vessel in heat exchange relation with the refrigerant evaporator coil 32.

Gas from the gas storage tank 17 is supplied through an on-off valve 41, adjustable flow regulator 42 and line 43 to the gas inlet 44 of the water storage vessel to maintain the water therein under a preselected substantially constant gas pressure determined by the pressure regulator 42. The gas is preferably carbon dioxide and the vessel 15 is preferably constructed as a conventional carbonator having means such as a gas diffuser 46 in the vessel for increasing the water-gas interface and thereby enhance absorption of the gas by the water.

Water under the pressure of the gas in the vessel 15 is fed through a water delivery line 51 to the proportioning apparatus 19. The syrup in the syrup storage vessel 16 is also maintained under substantially the same preselected gas pressure and is fed through a syrup delivery line 52 to the proportioner apparatus 19. As shown, gas under pressure from the water storage vessel 15 is supplied through a gas transfer line 53 to the syrup storage vessel 16 to maintain the latter under the same pressure as the water in the storage vessel.

Figure 4:
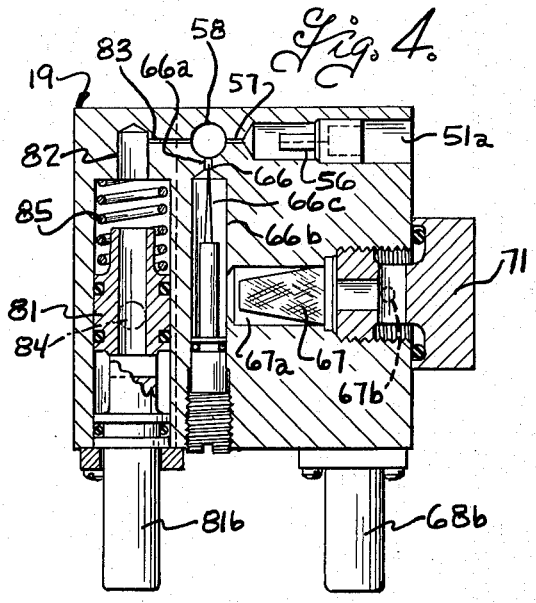
FIG. 4 is a sectional view taken on the plane 4—4 of FIG. 3.

Water and syrup under substantially the same gas pressure are metered and mixed in the proportioning apparatus 19 and the mixed beverage ingredients are supplied through a mixed beverage delivery line 54 having a delivery valve 55 therein for controlling flow through the delivery line. The proportioner has a water inlet 51*a* connected to the water delivery line and water from the water inlet passes through a check valve 56 and water flow restrictor 57 to a mixing chamber 58 as shown in FIG. 4. The check valve 56 is conveniently in the form of a resilient lip sealing valve and the flow restrictor 57 is in the form of a restricted passage in the body of the proportioner apparatus. The proportioner has a mixed beverage outlet 59 that communicates with the chamber 58 and which is connected to the mixed beverage delivery line 54. A syrup sensor 62, conveniently in the form of a float operated switch, is provided in the syrup delivery line 52 to sense when syrup is present or absent in the delivery line and the proportioner 19 has a syrup inlet 52*a* connected to the syrup delivery line 52. The proportioner 19 also has a syrup flow restrictor 66 having its outlet 66*a* connected to the mixing chamber 58 and an inlet 66*b* connected to the outlet 67*a* of a syrup filter 67. The syrup filter has an inlet 67*b* connected through a syrup control valve 68 to the syrup inlet. As diagrammatically shown in FIG. 1, the syrup control valve 68 is of a three-way type and is normally positioned as by a spring 69 in a position passing syrup from the syrup inlet 52*a* to the inlet 67*b* of the syrup filter 67 for flow through the syrup flow restrictor 66 to the mixing chamber 58. At least one of the flow restrictors 57, 66 is adjustable and, in the preferred embodiment, the syrup flow restrictor 66 is made adjustable to vary the relative proportions of the water and syrup which will flow through the respective flow restrictors under the same substantially constant preselected pressure to the syrup line, when the delivery valve 55 is open. As best shown in FIG. 4, the adjustable flow restrictor 66 is of the adjustable orifice type and comprises a needle valve 66*c* which is adjustable relative to the orifice 66 to vary the effective size of the orifice and hence the restriction to flow therethrough. The filter 67 can be of any suitable type and is herein shown in the form of a generally conical screen that is removably seated in a counterbore in the proportioner by a cap member 71.

Figure 5:
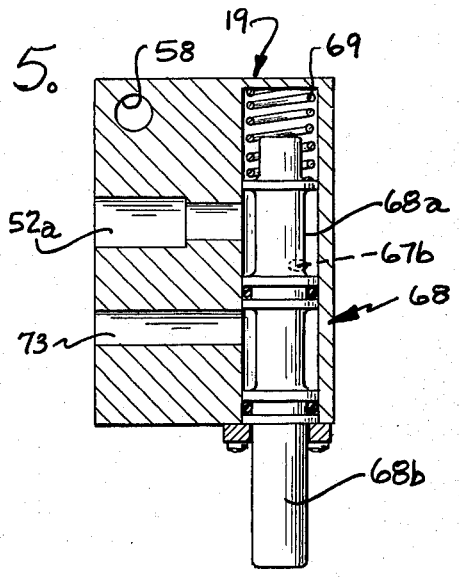
FIG. 5 is a sectional view taken on the plane 5—5 of FIG. 3.

It has been found that the syrup metering orifice tends to rapidly become clogged when syrup flows therethrough and that the provision of a syrup filter in advance of the syrup metering orifice is effective to reduce the rate at which the metering orifice becomes clogged but does not entirely stop clogging of the metering orifice and, moreover, itself rapidly becomes clogged or loaded with material. This is believed to be due to the small crystaline and gelatinous particles that are either present in the syrup due to improper mixing or which form in the syrup upon standing or when it passes through restricted passages such as the syrup metering orifice. The partial clogging of the syrup metering orifice and/or filter by gelatinous, crystaline or other foreign particles in the syrup, changes the flow impedance in the syrup metering line and hence changes the relative proportions of water and syrup supplied to the mixed beverage delivery line 54. In accordance with the present invention, provision is made for cleaning the syrup metering orifice and filter without requiring disassembly or removal of the same from the proportioning apparatus and further without adversely affecting the syrup in the syrup delivery line or the mixed beverage in the mixed beverage delivery line. More particularly, the syrup control valve 68 is arranged so as to effect back flushing of the syrup flow restrictor 66 and syrup filter 67, utilizing water delivered under gas pressure through the water delivery line 51. The valve 68 includes a valve member 68*a* which is normally biased by spring 69 to the position shown in FIGS. 1 and 5 in which it communicates the syrup inlet 52*a* with the inlet 67*b* of the syrup filter 67. The valve is selectively and preferably manually movable under the control of a push button 68*b* to a second position blocking flow of syrup from the syrup inlet and communicating the filter inlet 67*b* with a drain passage 73. When the valve member 68*a* is in its second position, water under gas pressure flows in the reverse direction through the syrup flow restrictor 66 and syrup filter 67 to the drain outlet to back flush and clean the syrup flow restrictor and filter. The back flushing and cleaning of the syrup flow restrictor and filter is thus achieved without requiring removal of the same from the proportioner or any change in the setting of the adjustable syrup flow restrictor. Moreover, since the syrup inlet is shut off during back flushing, contamination of the syrup line is avoided. In addition, since the pressurized water supply to the proportioner 19 is also used to effect back flushing, contamination of the mixed beverage delivery line is also avoided. The back flushing rapidly carries away any deposits in the syrup metering orifice or in filter and cleaning of the same can be effected in very short time, of the order of a few seconds. Because of the speed and the ease with which cleaning of the syrup metering orifice and filter can be achieved, the operators of the beverage dispensing machine can and normally will effect relatively frequent cleaning of the same to assure accurate proportioning of the water and syrup in the mixed beverage. To further facilitate the cleaning operation, the proportioning apparatus is preferably mounted as shown in FIG. 6 so that the push button actuator 68*b* is accessible from the front of the machine.

Figure 1:
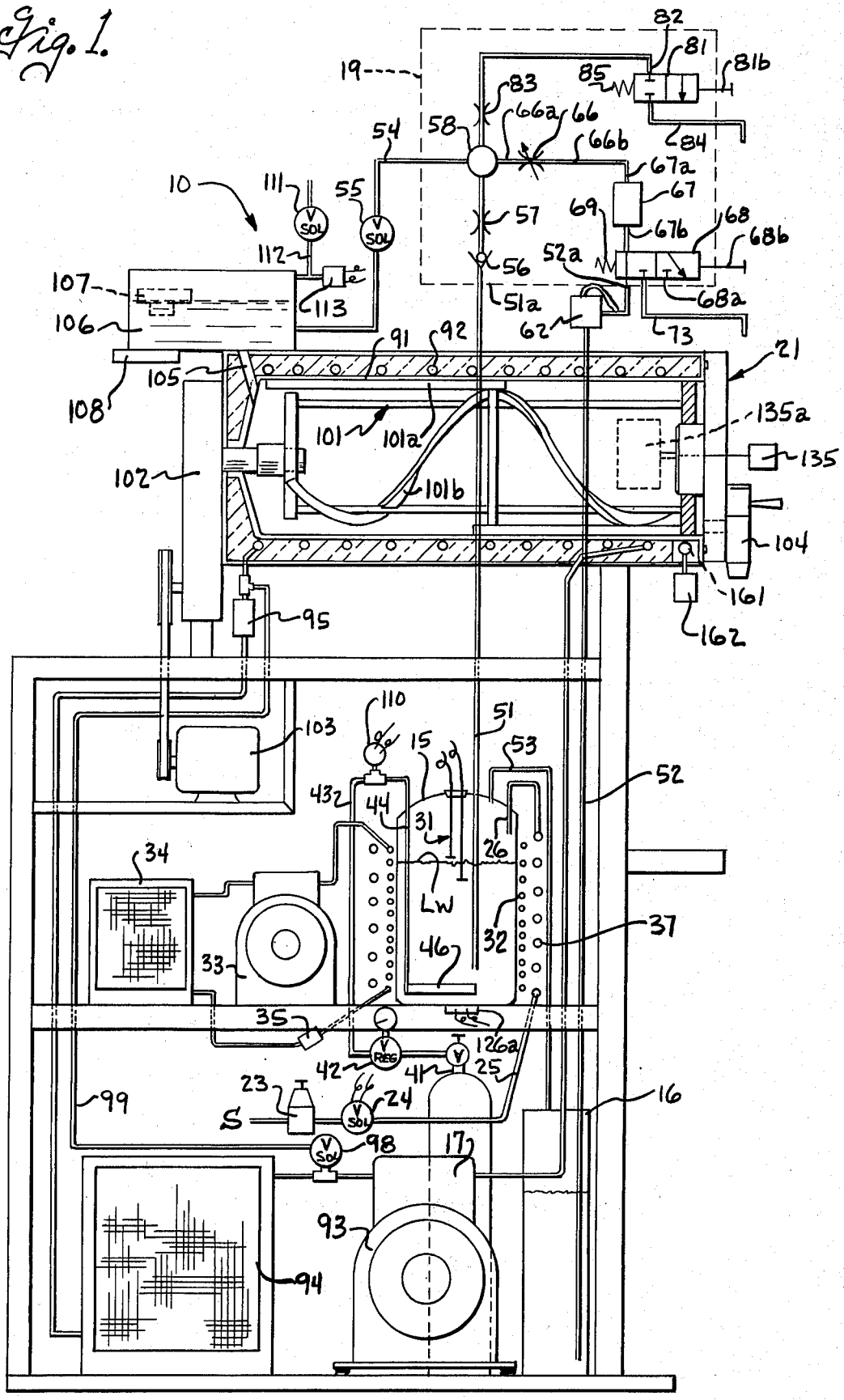
FIG. 1 is a diagrammatic view of a beverage dispensing system embodying the present invention for preparing and dispensing a semi-frozen beverage.

The water and syrup for producing the beverage mixture are mixed in the proportioner 19 and provision is advantageously made in the proportioner for sampling the beverage mixture before it passes through the mixed beverage delivery line to the freezing cylinder 21. In this manner, the beverage mixture can be checked and adjusted if necessary to achieve the desired proportions of water and syrup without having to drain or otherwise clear the entire freezing cylinder. As best shown in FIGS. 1 and 4, a beverage sampling valve 81 of the on-off type has its inlet 82 connected through a sample flow restrictor 83 to the mixing chamber 58 to receive mixed beverage therefrom and has its outlet connected to a sample delivery passage 84. The valve 81 is normally positioned by a spring 85 to block flow to the sample passage 84 and is movable under the control of a manually operable actuator 81*b* to an open position to pass a sample of the mixed beverage to the sample outlet passage 84. The beverage sample can then be analyzed to determine whether it has the proper syrup-water mixture and the syrup flow restrictor can then be adjusted, if necessary, in a direction to correct any error in the mixture. The rate of flow of water and syrup through their respective flow restrictors will vary with the pressure drop across the flow restrictors. Accordingly, the sample flow restrictor 83 is selected so as to produce a back pressure at the beverage mixing chamber 58, when the sample valve 81 is open, which pressure approximates the pressure in the mixed beverage delivery line 54 when the delivery line valve 55 is open.

The beverage dispensing apparatus and proportioning system is particularly adapted for use in dispensing semi-frozen beverages. The freezing cylinder 21 is of conventional construction and includes a freezing chamber 91 that is refrigerated by the evaporator coil 92 of a second refrigeration system including a compressor 93, condenser 94 and expansion control valve 95. The second refrigeration system is cycled on and off under the control of a temperature sensor 162 to maintain a temperature in the freezing chamber which is somewhat below normal water freezing temperature and sufficient to form ice and, for example, of the order of 25°–28° F. A defrost valve 98 is preferably provided in the refrigeration system and connected to pass hot gas from the compressor 93 through a by-pass line 99 to the inlet end of the evaporator coil 92 to effect rapid defrosting of the freezing cylinder when valve 98 is opened.

The freezing cylinder has a scraper and beater 101 mounted therein and driven as by a speed reducer 102 and drive motor 103. As is conventional, the beater 101 includes scraper blades 101*a* for removing frozen product from the chamber walls and agitator blades 101*b* for stirring and agitating the product in the freezing cylinder. A product dispensing valve 104 is connected to the forward end of the cylinder adjacent the cylinder end and is movable from a normally closed position to an open position to dispense semi-frozen product from the freezing chamber. Mixed beverage is supplied to the freezing chamber through a freezing chamber inlet 105 preferably located adjacent the top of the freezing chamber and at the end remote from the dispensing valve 104. A float chamber 106 communicates with the freezing chamber inlet 105 and is connected to the mixed beverage delivery line 54 to receive mixed beverage when the solenoid valve is opened. The float chamber 106 extends above the freezing chamber and has a means, such as a float 107 in the chamber and a float operated switch 108 for sensing the liquid level in the float chamber to determine when the freezing chamber is full of liquid. The beverage feed and proportioning apparatus can be utilized to deliver mixed beverage at atmospheric pressure to a freezing chamber having an atmospherically vented float chamber and with the delivery valve 55 controlled by the float operated switch 108 to open and close as required to maintain the freezing chamber filled. However, the carbon dioxide gas in the mixed beverage tends to escape at atmospheric pressure. In order to improve the amount of overrun and the consistency of the product, the mixed beverage is preferably delivered to the freezing chamber under a preselected pressure somewhat below the gas pressure maintained on the water and syrup storage vessels. In the preferred embodiment illustrated, the float chamber 106 is closed or sealed and an improved system is provided for delivering mixed beverage under pressure to the freezing chamber to maintain the pressure and liquid level in the chamber generally uniform. As diagrammatically shown in FIG. 1, a gas bleed valve 111 is connected through a line 112 to the float chamber above the liquid level therein. In addition, a pressure switch 113 is connected to sense the pressure in the float chamber and hence the pressure in the freezing chamber. The beverage delivery valve 55 and gas bleed valve 111 are operated under the control of the liquid level sensing switch 108 and pressure switch 113 to admit mixed beverage to the freezing chamber and bleed gas from the freezing chamber until the liquid reaches a preselected level and pressure in the freezing chamber.

Figures 2, 7:
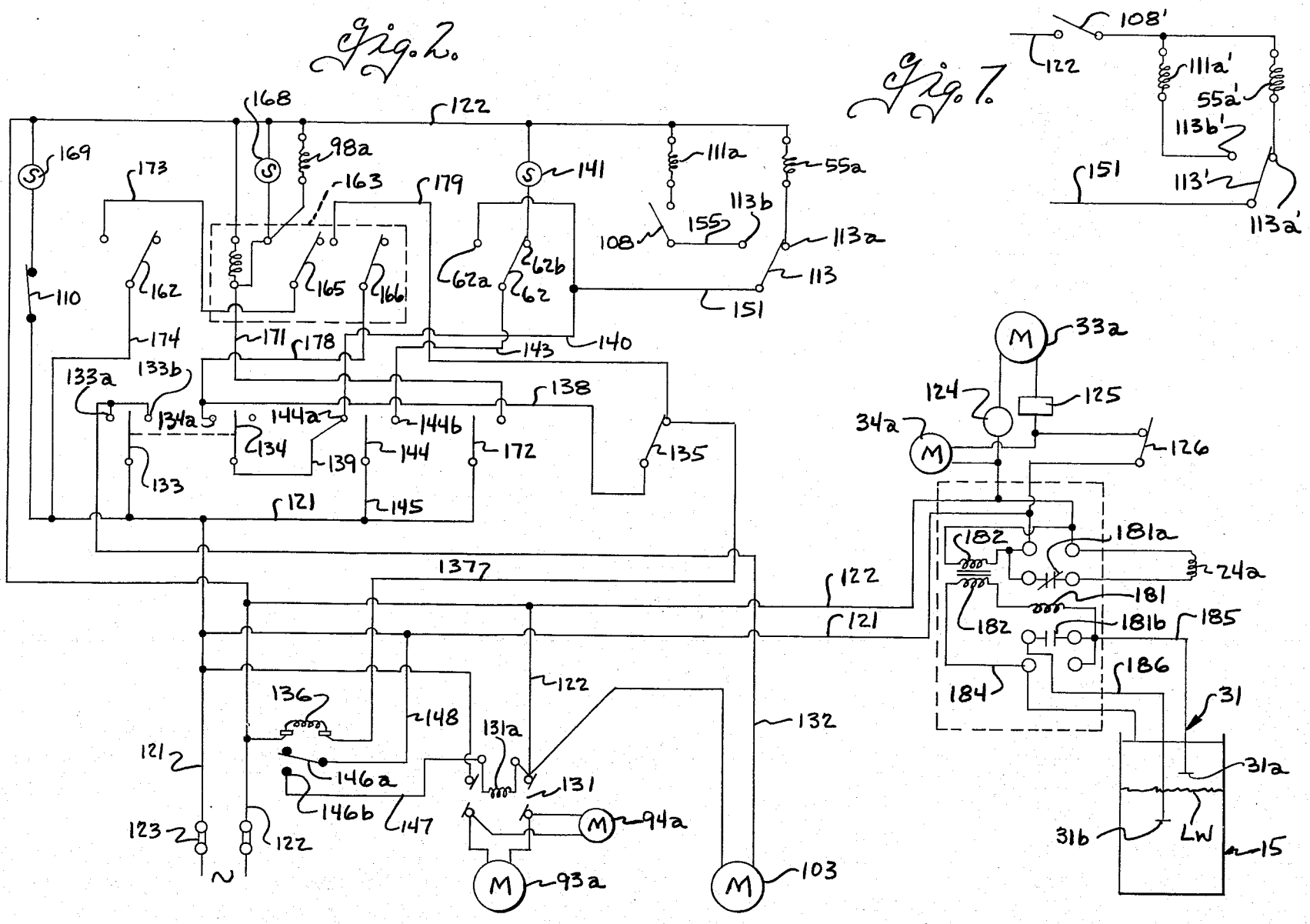
FIG. 2 is a schematic diagram of the electrical control system for the beverage dispensing system of FIG. 1.
FIG. 7 is a fragmentary schematic view illustrating a modification in the electrical control apparatus of FIG. 2.
Figure 3:
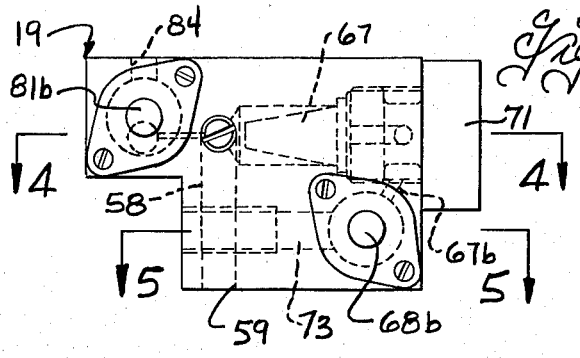
FIG. 3 is an end elevational view of an apparatus for proportioning the beverage ingredients.

Reference is now made more specifically to the schematic diagram of the electrical control circuit in FIG. 2. The main power supply conductors 121 are adapted for connection to a power supply source through circuit breakers 123. The motor 33*a* that drives the compressor 33 for the carbonator, is connected to the main power conductors 121 and 122 through an overload relay 124, start relay 125 and temperature control switch 126 operated by a temperature sensor 126*a* (FIG. 1) which senses the temperature in the carbonator. The sensor 126*a* is arranged to operate switch 126 to a closed position when the temperature in the carbonator rises above a preselected maximum, to thereby start the compressor motor and refrigerate the carbonator, and to open the switch 126 when the temperature drops to a preselected minimum to stop refrigeration of the carbonator and thereby maintain the temperature of the liquid in the carbonator between preselected limits, for example around 34°–36° F. The condenser fan motor 34*a* for the condenser 34 is connected so as to be started when the switch 126 is closed.

The drive motor 93*a* for the freezing chamber refrigeration compressor 93 and the condenser cooling fan motor 94*a* for the condenser 94 are connected to the main power conductors 121 and 122 through a start relay 131 operated by a relay coil 131*a*. The beater drive motor 103 is connected to the main power conductor 122 and through a conductor 132 and manually operable switch 133 to the other main power conductor 121 to start the beater motor whenever the switch 123 is moved into engagement with either contacts 133*a* or 133*b*. The beater motor 103 will therefore drive the beater continuously whenever the switch 133 is moved to a position into engagement with contact 133*a* and the refrigeration apparatus for the freezing cylinder is preferably operated under the control of a switch 135 operated by a mechanism 135*a* (FIG. 1) which senses the freezing condition in the freezing chamber. The mechanism 135*a* is conveniently of the type shown in the U.S. Pat. to Harker No. 3,298,190 issued Jan. 17, 1967 and which is arranged to sense the viscosity or stiffness of the semi-frozen product in the freezing chamber and to start and stop the refrigeration apparatus to maintain the product at a preselected consistency. The consistency sensing switch 135 is normally closed and is opened only when the consistency of the product increases above a preselected maximum. As shown in FIG. 2, a relay coil 136 is connected to one of the power conductors 122 and through conductor 137 and normally closed viscosity switch 135 to a conductor 138. Conductor 138 is connected to contact 134*a* of a manually operated switch 134 and switch 134 is connected through conductors 139 and 140 to a contact 62*a* of the syrup sensing switch 62. Syrup sensing switch 62 is herein shown of the two-position type which is arranged to engage contact 62*b* in the absence of syrup in the syrup delivery line and to complete a circuit to an indicator lamp 141. When syrup is present in the delivery line, switch 62 is moved into engagement with contact 62*a* and switch 62 is connected through conductor 143 to a contact 144*b* of a manually operable fill switch 144. The fill switch 144 is manually operable and, during normal operation of the beverage dispenser, is moved to a "fill" position engaging contact 144*b*. Switch 144 is otherwise connected through conductor 145 to the power conductor 121 to thereby complete a circuit through relay coil 136 when the fill switch 144 is in its fill position engaging contact 144*b* and when the switch 134 is in its "automatic" position engaging contat 134*a* and the syrup sensing switch 67 senses the presence of syrup in syrup delivery line and engages contact 62*a*. When coil 136 is energized, it closes relay contacts 146*a* and 146*b* and completes a circuit from conductor 122 through the compressor motor start relay 131*a*, conductor 147, contacts 146*b*, 146*a*, and conductor 148 to main power conductor 121 to start the compressor drive motor. Operation of the refrigeration system will then be under the control of the viscosity sensing switch 135 which starts and stops the compressor to maintain a preselected product viscosity. When starting up the system, the syrup line is sometimes filled with air or gas and the syrup sensing switch will remain in engagement with contact 62*b*. In order to start the system under these circumstances, switch 144 is manually movable into momentary engagement with contact 144*a*. This completes a circuit from conductor 139 to the main power conductor 121 and by-passes the syrup sensing motor.

The product pressure switch 113 is connected through conductor 151, conductor 140, syrup sensing switch 62, condenser 143 and fill switch 144 to the main power conductor 121 to complete a circuit to the solenoid 55*a* for the delivery valve to open the same under the control of the pressure switch 113. As shown in FIG. 2, product pressure switch 113 is of the twoposition type and is normally positioned in engagement with contacts 113*a* when the pressure is below a preselected value to complete a circuit to the solenoid 55*a* for the delivery valve 55 to open the same. This will allow fluid to flow through the delivery line to the float chamber 106 and freezing chamber 91. The pressure operated switch 113 will thus open and close contacts 113*a* to open and close the delivery line valve 55 as required to maintain the product in the freezing chamber within a preselected pressure range below the gas pressure maintained on the water and syrup supply sources. For example, if the gas pressure regulator 42 for the pressurizing gas from the tank 17 is set to maintain a pressure of about 30 p.s.i. in the water and syrup storage vessels, then the pressure switch 113 is set to operate at a somewhat lower pressure, for example 20 p.s.i. and to close contacts 115*a* when the pressure drops to a minimum value for example 18 p.s.i. and open contacts 113 when the pressure rises to an upper value such as 20 p.s.i.

Provision is made for automatically bleeding any excess gas from the freezing chamber to maintain the same filled with product. As shown in FIG. 7, contact 113*b* of the pressure switch 113 is connected through conductor 155 to the level sensing switch 108 and the level sensing switch is connected to the electro-responsive operator or solenoid 111*a* for the bleed valve 111. As will be seen, the pressure switch 113 will establish a circuit through contact 113*b* to the level switch 108 only when the pressure in the freezing chamber is above the minimum of 20 p.s.i. and, if the liquid level is below the desired level, the switch 108 is closed to open the bleed valve and bleed off gas from the freezing chamber. This reduces the pressure in the freezing chamber so that the pressure switch 113 will move back into engagement with contact 113*a* and again open delivery valve 55. A gas indicator lamp 109 operated under the control of a pressure switch 110 in the gas line 43 is advantageously provided to indicate when the gas tank 17 is out of gas.

The control circuit also includes a defrost circuit for operating the defrost valve 98 in the freezing cylinder refrigeration system. A defrost temperature sensor 161 mounted to sense the temperature of the freezing cylinder preferably adjacent the delivery end and is arranged to operate a switch 162. A defrost relay 163 includes a defrost relay coil 164 and first and second relay operated switches 165 and 166. The defrost relay coil 164, the solenoid 98*a* for operating the defrost valve 98 and an indictor light 168 are connected in parallel from conductor 122 and through conductor 171 to a normally open manually operable defrost switch 172. The defrost switch 172 is operative, when closed, to complete a circuit to the other main power conductor 121 and thereby energize the defrost solenoid 98*a* and to also energize the defrost relay coil 164. The normally open switch 162 operated by the defrost temperature sensor is connected through conductor 174 to the main power conductor 121 and is connected through conductor 173 to the relay switch 165. Thus, if the defrost temperature sensor senses that the temperature in the freezing chamber is below a selected value, it will close switch 162 and, when the defrost relay 164 is operated in response to closing of the manually operable defrost switch 172, switch 165 will establish a holding circuit to maintain the defrost solenoid 98 and defrost relay 164 energized. Relay switch 166 is connected through conductor 178 to conductor 138 and relay contact 166*a* is connected through conductor 179 to conductor 137. This establishes a circuit in parallel to the viscosity sensing switch 135 to energize the control relay coil 136 if the switch 135 is open and maintain the refrigeration compressor energized during defrost of the system.

The liquid level sensing means 31 for maintaining a preselected liquid level in the water supply vessel can be of any suitable construction for operating water control valve 24 to maintain the liquid level in the vessel. In the embodiment shown, the level sensor is of the dual-probe type having probes 31*a* and 31*b*. The electro-responsive actuator 24*a* for the water control valve 24 is connected through normally closed relay contacts 181*a* to the main power conductors 121 and 122. The probes are energized from the secondary 182*a* of a transformer 182 connected to the power supply. One side of the secondary of the transformer is connected through a conductor 184 to the electrically conductive vessel 15 and the other side of the secondary is connected through a relay coil 181 and conductor 185 to one of the probes 31*a*. The relay coil 181 is also connected through normally open relay contacts 181*b* and conductor 186 to the other of the probes 31*b*. When the liquid in the receptacle reaches the upper probe 81*a*, it completes a circuit between conductor 184 and conductor 185 to energize the relay coil 181. This opens the normally closed contacts 181*a* to deenergize the solenoid 24*a* and close the water control valve 24. Energization of coil 181 also closes the normally open contacts 181*b* to establish a circuit to the lower probe 31*b*. The coil 181 will therefore remain energized until the liquid drops below the probe 31*b*. At that time, relay coil 181 is deenergized and allows normally open contacts 181*a* to close and reenergize the water control valve to its open position.

A modified circuit for operating the bleed valve solenoid 111*a* and delivery valve solenoid 55*a* as illustrated in FIG. 7 and like numerals followed by the postscript [(1)] are used to designate the corresponding parts. In the previous embodiment, the level sensing switch 108 was connected in series only with the bleed solenoid 111*a* to operate the bleed solenoid to its open position when the pressure was above a preselected value and the liquid level below a preselected value. In the modified circuit shown in FIG. 7, the liquid level sensing switch 108′ is connected in series with both the bleed valve solenoid 111*a′* and the fill valve solenoid 55*a′*, to also prevent opening c[f] the delivery valve in the event the liquid level is abo a preselected value. More particularly, as shown in FIG. 7, the pressure switch 113′ is connected to conductor 151 and contacts 113*a′* and 113*b′* are respectively connected to the delivery valve solenoid 55*a′* and the bleed solenoid 111*a′*. Both the fill solenoid and bleed solenoid are otherwise connected in series with the normally open liquid level sensing switch 108′ to main power conductor 122. With this arrangement, the float chamber cannot be overfilled even if there is a loss of gas pressure due to a leak or the like, since the liquid level sensing switch 108 will also prevent the opening of the delivery valve when the liquid is above a preselected level. This allows some room for the semi-frozen product in the freezing chamber to expand and thus prevents build-up of excessive pressure in the freezing chamber due to expansion of the beverage as it freezes.

From the foregoing it is thought that the construction and operation of the beverage dispensing system will be readily understood. The water and flavoring syrup are separately stored in vessels 15 and 16 under the same substantially constant gas pressure, for example about 30 p.s.i. and are delivered under this gas pressure through the water and syrup delivery lines 51 and 52 to the proportioner 19. The water and syrup will flow through their respective flow restrictors 57 and 62 to the mixed beverage delivery line when the delivery valve 55 is open at rates controlled by relative impedances of the flow restrictors 57 and 66. A sample of the mixed beverage can be obtained before passage to the freezing chamber by operating the sample valve 81 to its open position. As previously described, the sample flow restrictor 83 is adjusted to maintain a back pressure in the system correlative with the pressure in the delivery line when the valve 55 is open to assure that the composition of the sample is substantially the same as will be supplied to the delivery line. If the composition of the sample is in error, the proportions can be adjusted by adjusting the flow restrictor 66 and a new sample taken again before introduction into the freezing chamber. In this manner, the effect of changes of the flow restrictors on the sample composition can be quickly determined and without requiring draining or removal of the material from the freezing chamber.

The syrup flow restrictor 66 and syrup filter 67 will become clogged more or less frequently during dispensing. They can be readily cleaned in place by manually operating the back flush valve 68 to shut off the flow of syrup while venting the filter inlet to drain to cause the water under gas pressure to flow in the reverse direction through the syrup flow restrictor and filter.

During normal operation of the beverage dispenser, switch 133 is manually positioned in engagement with contact 133*a;* switch 134 in engagement with contact 134*a* and switch 144 in engagement with contact 144*b*. The control circuit will then operate the delivery valve 55 under the control of the product pressure sensing switch 113 to maintain the pressure in the freezing chamber and hence the back pressure on the proportioner at a preselected value such as 20 p.s.i. which is substantially below the gas pressure on the water and syrup in the vessels 15 and 16. The gas bleed valve 111 is automatically operated under the control of the liquid level sensing switch to bleed off any excess gas to maintain the freezing chamber filled. The refrigeration compressor 93 is operated under the control of the viscosity sensing switch 135 to maintain a preselected product viscosity.

The embodiments of the invention in which an exclusive property or privilege is claimed are defined as follows:

1. An apparatus for dispensing beverages containing water, a flavoring syrup and food-grade gas comprising, a mixed beverage delivery line having delivery valve means movable between an open and a closed position for controlling flow of mixed beverage therethrough, water storage means for storing a quantity of water and having a water feed line, syrup storage means for storing a quantity of flavoring syrup and having a syrup feed line, water flow restricting means connecting said water feed line to said beverage delivery line, a syrup filter having a filter inlet and a filter outlet and a syrup flow restricting means connecting the filter outlet to said beverage delivery line, a syrup control valve means having a first connection to said syrup feed line; and a second connection to said filter inlet and a drain connection, said syrup control valve means including means selectively movable from a normal position communicating said first connection with said second connection while blocking flow through the drain connection and a back flush position blocking flow through the first connection while communicating the second connection with the drain connection, gas pressurizing means including a source of food-grade gas for supplying gas under a preselected substantial constant pressure to said gas inlet of said water storage means to feed water under the gas pressure through the water feed line and water flow restricting means to the beverage delivery line, said gas pressurizing means including means for supplying gas under substantially the same preselected pressure to said gas inlet of said syrup storage means to feed syrup under the gas pressure through the syrup feed line and in one direction through the filter and syrup flow restricting means to the beverage delivery line when said syrup control valve is in its normal position, said syrup control valve being operative in its back flush position to block the flow of syrup from the syrup feed line and to communicate the filter inlet with the drain connection whereby water under the gas pressure from the water feed line will flow in the other direction through the syrup flow restricting means and syrup filter to drain to back flush the same.

2. An apparatus for dispensing beverages according to claim 1 wherein at least one of flow restricting means is adjustable to relatively vary the rates of flow of syrup and water through the respective syrup and water flow restricting means under said preselected gas pressure.

3. An apparatus for dispensing beverages according to claim 1 wherein said syrup flow restricting means is adjustable to vary the rate of flow of syrup relative to the rate of flow of water when the delivery line valve is open.

4. An apparatus for dispensing beverages according to claim 1 including a normally closed sample valve connected to said delivery line and selectively movable to an open position to pass a sample of mixed beverage therefrom, and sample flow restricting means for restricting the rate of flow through the sample valve when the sample valve is open to maintain a substantial pressure in the delivery line.

5. An apparatus for dispensing semi-frozen beverages containing water, flavoring syrup and a food-grade gas comprising, a freezing chamber having a rotary beater therein for freezing a semi-frozen beverage, a dispensing valve connected to the freezing chamber for dispensing beverage therefrom, beverage delivery means including a mixed beverage delivery line for conveying mixed beverage to the freezing chamber, water storage means for storing a quantity of water and having a gas inlet and water feed line, syrup storage means for storing a quantity of flavoring syrup and having a gas inlet and a syrup feed line, water flow restricting means connecting the water feed line to said beverage delivery line, a syrup filter having a filter inlet and a filter outlet and a syrup flow restricting means connecting the outlet of the syrup filter to said beverage delivery line, a syrup control valve means having a first connection to the syrup feed line and a second connection to the filter inlet and a drain connection, said syrup control valve means including means selectively movable from a normal position communicating said first connection with said second connection while blocking flow through the drain connection and back flush position blocking flow through the first connection while communicating the second connection with the drain connection, gas pressurizing means including a source of food-grade gas for supplying gas under a preselected substantially constant pressure to said gas inlet of said water storage means to feed water under the gas pressure through the water feed line and water flow restricting means to the beverage delivery line, said gas pressurizing means including means for supplying gas under substantially the same preselected pressure to said gas inlet of said syrup storage means to feed syrup under the gas pressure through the syrup feed line and in one direction through the filter and flow restricting means to the beverage delivery line when said syrup control valve is in its normal position, said syrup control valve being operative in its back flush position to block the flow of the syrup from a syrup feed line and to communicate the filter inlet with the drain connection whereby water under the gas pressure from the water feed line will flow in the other direction through the syrup flow restricting means and syrup filter to drain to back flush the same.

6. An apparatus for dispensing semi-frozen beverages according to claim 5 wherein at least one of the flow restricting means is adjustable to relatively vary the rates of flow of syrup and water through the respective syrup and water flow restricting means under said preselected gas pressure.

7. An apparatus for dispensing semi-frozen beverages according to claim 5 wherein said source of food-grade gas comprises a tank of carbon dioxide gas, and said water storage means includes means for carbonating the water therein.

8. An apparatus for dispensing semi-frozen beverages according to claim 5 including a delivery valve in the delivery line movable between an open and a closed position for controlling flow of mixed beverage to the freezing chamber, and delivery valve control means for operating said delivery valve to maintain freezing chamber filled to a preselected level.

9. An apparatus for dispensing semi-frozen beverages according to claim 8 wherein said delivery valve control means includes means for closing said delivery valve when the pressure in the freezing chamber reaches a value substantially below said preselected gas pressure.

10. An apparatus for dispensing semi-frozen beverages according to claim 8 including a sample valve communicating with said delivery line ahead of the delivery valve and selectively movable from a normally closed position to an open position to allow sampling of the mixed beverage before it enters the freezing chamber.

11. An apparatus for dispensing semi-frozen beverages according to claim 5 including a delivery valve in the delivery line movable between an open position and a closed position for controlling flow of mixed beverage to the freezing chamber, delivery valve operating means responsive to the pressure in the freezing chamber for closing the delivery valve when the pressure in the freezing chamber reaches a pre-set upper pressure substantially below said preselected gas pressure and for opening the delivery line valve to allow flow of mixed beverages to the freezing chamber when the pressure drops to a pre-set lower pressure below said pre-set upper pressure.

12. An apparatus for dispensing semi-frozen beverages according to claim 11 including a sample valve communicating with the delivery line ahead of the delivery valve and movable from a normally closed position to an open position to allow sampling of the mixed beverage before it enters the freezing chamber.

13. An apparatus for dispensing semi-frozen beverages according to claim 12 including sample flow restricting means for restricting the flow through the sample valve when the latter is open to maintain the pressure in the delivery line substantially above atmospheric pressure.

14. An apparatus for dispensing semi-frozen beverages according to claim 5 wherein said beverage delivery means is operative to deliver the mixed beverage under pressure to the freezing chamber and includes a delivery valve in the delivery line movable between an open and a closed position for controlling flow of mixed beverage to the freezing chamber, a gas bleed valve movable between a closed and an open position and connected to bleed gas from the freezing chamber, liquid level means for sensing the liquid level in the chamber, pressure sensing means for sensing the fluid pressure on the beverage in freezing chamber, and control means responsive to said liquid level sensing means and said pressure sensing means for operating said delivery valve and said bleed valve to admit mixed beverage to the freezing chamber and bleed gas from the chamber until the liquid reaches a selected level and pressure in the freezing chamber.

15. An apparatus for dispensing semi-frozen beverages according to claim 14 wherein said control means is operative to close said bleed valve when the delivery valve is open.

16. An apparatus for dispensing semi-frozen beverages according to claim 5 wherein said beverage delivery means is operative to deliver the mixed beverage under pressure to the freezing chamber and includes a delivery valve in the delivery line movable between an open and a closed position for controlling flow of mixed beverage to the freezing chamber, delivery valve operating means responsive to the pressure in said freezing chamber for closing the delivery valve when the pressure in a freezing chamber reaches a pre-set upper pressure substantially below said preselected gas pressure and for opening the delivery line valve to allow flow of mixed beverage to the freezing chamber when the pressure drops below said pre-set pressure, a gas bleed valve connected to bleed gas from the freezing chamber, liquid level sensing means for sensing the presence of excess gas in the freezing chamber, gas bleed valve operating means responsive to said liquid level sensing means for operating said gas bleed valve to its open position when excess gas is present in the freezing chamber.

17. An apparatus for dispensing semi-frozen beverages containing water, flavoring syrup and a food-grade gas comprising, a freezing chamber having a rotary beater therein for freezing a semi-frozen beverage, a dispensing valve connected to the freezing chamber for dispensing beverage therefrom, beverage delivery means including a mixed beverage delivery line for delivering mixed beverage under pressure to the freezing chamber, a delivery valve in the delivery line movable between an open and a closed position for controlling flow of mixed beverage to the freezing chamber, a gas bleed valve movable between an open and a closed position and connected to bleed gas from the freezing chamber, liquid level sensing means for sensing the liquid level in the chamber, pressure sensing means for sensing the pressure on the beverage in the freezing chamber, and control means responsive to said liquid level sensing means and said pressure sensing means for operating said delivery valve and said bleed valve to admit mixed beverage to the freezing chamber and bleed gas from the chamber until the liquid reaches a preselected level and pressure in the freezing chamber.

18. An apparatus for dispensing semi-frozen beverages according to claim 17 wherein said control means is operative to close said bleed valve when the delivery valve is open and close said delivery valve when the bleed valve is open.

19. An apparatus for dispensing semi-frozen beverages according to claim 18 wherein said liquid level sensing means includes an enclosed beverage chamber external to said freezing chamber and connected to said delivery line and to said freezing chamber, and means for sensing the liquid level in the beverage chamber.

20. An apparatus for dispensing semi-frozen beverages according to claim 17 wherein said liquid level sensing means includes an enclosed beverage chamber external to said freezing chamber and connected to said delivery line and to said freezing chamber, and means for sensing the liquid level in the beverage chamber.

* * * * *